US010425736B2

(12) United States Patent
Hui et al.

(10) Patent No.: US 10,425,736 B2
(45) **Date of Patent: *Sep. 24, 2019**

(54) SYSTEM AND APPARATUS FOR BOOMLESS-MICROPHONE CONSTRUCTION FOR WIRELESS HELMET COMMUNICATOR WITH SIREN SIGNAL DETECTION AND CLASSIFICATION CAPABILITY

(71) Applicant: BITWAVE PTE LTD., Singapore (SG)

(72) Inventors: Siew Kok Hui, Singapore (SG); Eng Sui Tan, Singapore (SG)

(73) Assignee: BITWAVE PTE LTD., Singapore (SG)

( * ) Notice: Subject to any disclaimer, the term of this patent is extended or adjusted under 35 U.S.C. 154(b) by 0 days.

This patent is subject to a terminal disclaimer.

(21) Appl. No.: 15/640,133

(22) Filed: Jun. 30, 2017

(65) Prior Publication Data

US 2017/0301339 A1 Oct. 19, 2017

Related U.S. Application Data

(60) Continuation of application No. 15/366,658, filed on Dec. 1, 2016, now Pat. No. 9,721,557, which is a (Continued)

(51) Int. Cl.
*H04R 5/033* (2006.01)
*G08G 1/0965* (2006.01)

(Continued)

(52) U.S. Cl.
CPC ..... *H04R 5/0335* (2013.01); *G08B 3/00* (2013.01); *G08G 1/0965* (2013.01);

(Continued)

(58) Field of Classification Search
CPC .... H04R 5/033; H04R 1/1083; H04R 5/0335; H04R 1/406; H04R 2225/43;

(Continued)

(56) References Cited

U.S. PATENT DOCUMENTS 5,699,436 A * 12/1997 Claybaugh ..... G10K 11/178 381/71.6
9,544,692 B2 1/2017 Hui et al.

(Continued)

FOREIGN PATENT DOCUMENTS

JP 7-327295 * 12/1995 ..... H04R 3/00
JP H07327295 A 12/1995

OTHER PUBLICATIONS

Extended European Search Report dated Feb. 10, 2014 for European Application EP 13 19 3065, 10 pages.

(Continued)

*Primary Examiner* — Lun-See Lao
(74) *Attorney, Agent, or Firm* — Amin, Turocy & Watson, LLP

(57) ABSTRACT

Boomless-microphones are described for a wireless helmet communicator with siren signal detection and classification capabilities. An acoustic component receives an audio signal and comprises a left acoustic sensor and a right acoustic sensor. The left acoustic sensor is mountable or attachable to the surface of a left wall of a helmet and the right acoustic sensor is mountable or attachable to the surface of a right wall. A speaker component can generate an echoless audio signal via signal inversion of the audio signal, outputs to a left speaker mountable or attachable to a left ear area of the helmet and a right speaker mountable or attachable to a right ear area of the helmet. A signal enhancement component can increase an intensity of the first audio signal associated with an emergency siren based on a determined proximity of an emitting emergency vehicle or emergency object to the device.

20 Claims, 16 Drawing Sheets

Related U.S. Application Data division of application No. 14/076,888, filed on Nov. 11, 2013, now Pat. No. 9,544,692.

(60) Provisional application No. 61/728,066, filed on Nov. 19, 2012.

(51) Int. Cl.

| | |
|---|---|
| ***H04R 1/40*** | (2006.01) |
| ***G08B 3/00*** | (2006.01) |
| ***G10K 11/178*** | (2006.01) |
| *G10L 21/00* | (2013.01) |

(52) U.S. Cl.

CPC ..... *G10K 11/178* (2013.01); *H04R 1/406* (2013.01); *H04R 5/033* (2013.01); *G10K 2210/1081* (2013.01); *G10K 2210/3014* (2013.01); *G10K 2210/3046* (2013.01); *G10K 2210/505* (2013.01); *G10L 21/00* (2013.01)

(58) Field of Classification Search

CPC ..... H04R 2225/55; H04R 2460/01; H04R 25/554; H04R 3/005; H04R 1/1041; H04N 13/044; H04N 13/0495; H04N 5/23258; H04N 5/23261; H04N 5/23267; H04N 5/23287; H04N 7/185; H04W 4/008; H04W 4/027; H04W 4/04; H04W 4/046; H04W 4/16

USPC ..... 381/74, 71.11–71.14, 94.1–94.5, 381/71.1–71.6; 700/94

See application file for complete search history.

(56) References Cited

U.S. PATENT DOCUMENTS

| | | | | |
|---|---|---|---|---|
| 2001/0046304 | A1* | 11/2001 | Rast | H04R 1/1041 381/74 |
| 2006/0083387 | A1 | 4/2006 | Emoto | |
| 2006/0270468 | A1 | 11/2006 | Hui et al. | |
| 2008/0008342 | A1* | 1/2008 | Sauk | H04S 1/002 381/315 |
| 2009/0010444 | A1* | 1/2009 | Goldstein | H03G 3/342 381/66 |
| 2010/0141439 | A1* | 6/2010 | Lunner | G01H 3/14 340/540 |
| 2010/0278350 | A1* | 11/2010 | Rung | G01H 3/14 381/59 |
| 2012/0215519 | A1* | 8/2012 | Park | G06F 17/289 704/2 |
| 2013/0301850 | A1* | 11/2013 | Usher | H04M 1/22 381/74 |

OTHER PUBLICATIONS

European Office Action dated Jul. 23, 2015 for European Patent Application Serial No. EP13193065, 5 pages.

Non-Final Office Action dated Feb. 23, 2016 for U.S. Appl. No. 14/076,888, 27 pgs.

European Office Action dated Feb. 15, 2016 for European Patent Application Serial No. EP13193065, 7 pages.

European Office Action dated Jan. 4, 2017 for European Application Serial No. 13 193 065.3-1910, 7 pages.

Notice of Allowance dated Mar. 29, 2017 for U.S. Appl. No. 15/366,658, 35 pages.

* cited by examiner

SYSTEM AND APPARATUS FOR BOOMLESS-MICROPHONE CONSTRUCTION FOR WIRELESS HELMET COMMUNICATOR WITH SIREN SIGNAL DETECTION AND CLASSIFICATION CAPABILITY

CROSS REFERENCE TO RELATED APPLICATION

This application is a continuation of, and claims priority to each of, U.S. patent application Ser. No. 15/366,658 (now U.S. Pat. No. 9,721,557), filed Dec. 1, 2016, and entitled "System and Apparatus for Boomless-Microphone Construction For Wireless Helmet Communicator with Siren Signal Detection and Classification Capability," which is a divisional of, and claims priority to, U.S. patent application Ser. No. 14/076,888 (now U.S. Pat. No. 9,554,692), filed Nov. 11, 2013 and entitled "System and Apparatus for Boomless-Microphone Construction For Wireless Helmet Communicator with Siren Signal Detection and Classification Capability," which is a non-provisional of, and claims priority to, U.S. Provisional Patent Application No. 61/728,066, filed Nov. 19, 2012 and entitled "System And Apparatus for Boomless-microphone Construction For Wireless Helmet Communicator with Siren Signal detection and classification capability," which applications are hereby incorporated by reference herein in their respective entireties.

TECHNICAL FIELD

This disclosure relates to configuring a set of microphones and speakers to minimize interference signals as well as detect, classify, and/or enhance particular signals such as warning signals.

BACKGROUND

Given the advancement in wireless communication technology a variety of hands-free communication solutions have been developed. In an instance, a hand-free communication technology within a helmet is conventionally designed to include a noise cancellation microphone and voice input channel to a headset. Often, the design of these technologies allow the microphone to receive near field signals only, mainly the speech of the user wearing the headset. However, far-field signals such as warning sounds or siren signals from emergency vehicles are not received by the microphone due to the noise cancellation properties of the microphone.

This deficiency leaves the headset user at risk of danger if an emergency vehicle is approaching. For instance, the user could be a motorcycle rider wearing the headset while talking on the phone or listening to music thereby lacking awareness for the need to give way to an approaching emergency vehicle. Furthermore, existing headset technologies are susceptible to receiving interference noise due to weather conditions such as wind. Additionally, the headsets within an open helmet, such as a three quarter shell or half shell helmet or helmets absent a visor, are susceptible to damage due to weather conditions such as rain and snow. Thus, an inability of existing headset technologies to warn a user of emergency vehicles remains.

SUMMARY

The following presents a simplified summary of the disclosure in order to provide a basic understanding of some aspects of the disclosure. This summary is not an extensive overview of the disclosure. It is intended to neither identify key or critical elements of the disclosure nor delineate any scope of particular embodiments of the disclosure, or any scope of the claims. Its sole purpose is to present some concepts of the disclosure in a simplified form as a prelude to the more detailed description that is presented later.

In accordance with one or more embodiments and corresponding disclosure, various non-limiting aspects are described in connection with a signal processing device. In accordance with a non-limiting embodiment, in an aspect, a device is provided comprising a processor, coupled to a memory, that executes or facilitates execution of one or more executable components, comprising an acoustic component that receives an audio signal, wherein the acoustic component comprises a left acoustic sensor and a right acoustic sensor, and wherein the left acoustic sensor is mountable or attachable to the surface of a left wall of a helmet and the right acoustic sensor is mountable or attachable to the surface of a right wall of the helmet. The components can further comprise a speaker component that generates an echoless audio signal via signal inversion of the audio signal, wherein the speaker component outputs to a left speaker mountable or attachable to a left ear area of the helmet and a right speaker mountable or attachable to a right ear area of the helmet. The components can further comprise a permission component that permits the acoustic component to receive a first audio signal determined to originate within a beam forming region and prevents the acoustic component from reception of a second audio signal determined to originate outside the beam forming region, wherein the beam forming region comprises a spatial zone comprising a frontal opening of the helmet between the acoustic component and the speaker component and defined relative to the device, wherein the first audio signal and the second audio signal are determined to traverse the spatial zone. The components can further comprise a signal enhancement component that increases an intensity of the first audio signal associated with an emergency siren based on a determined proximity of an emergency vehicle or emergency object, that produces the emergency siren, to the device.

Further, in accordance with one or more embodiments and corresponding disclosure, a method is provided comprising capturing, by a device comprising a processor, sound wave data determined to originate from within a spatial region or sound data originating from an emergency vehicle siren by a left acoustic microphone associated with a left ear compartment of a headgear and a right acoustic microphone associated with a right ear compartment of the headgear. The method can further comprise initiating rendering of sound waves out of phase between a left speaker and a right speaker forming an acoustic echo cancelling region with respect to the left acoustic microphone, the right acoustic microphone and a user mouth. The method can further comprise filtering environmental noise determined to originate outside the echo cancelling region.

The following description and the annexed drawings set forth certain illustrative aspects of the disclosure. These aspects are indicative, however, of but a few of the various ways in which the principles of the disclosure may be employed. Other aspects of the disclosure will become apparent from the following detailed description of the disclosure when considered in conjunction with the drawings.

DETAILED DESCRIPTION

Overview

Figure 1:
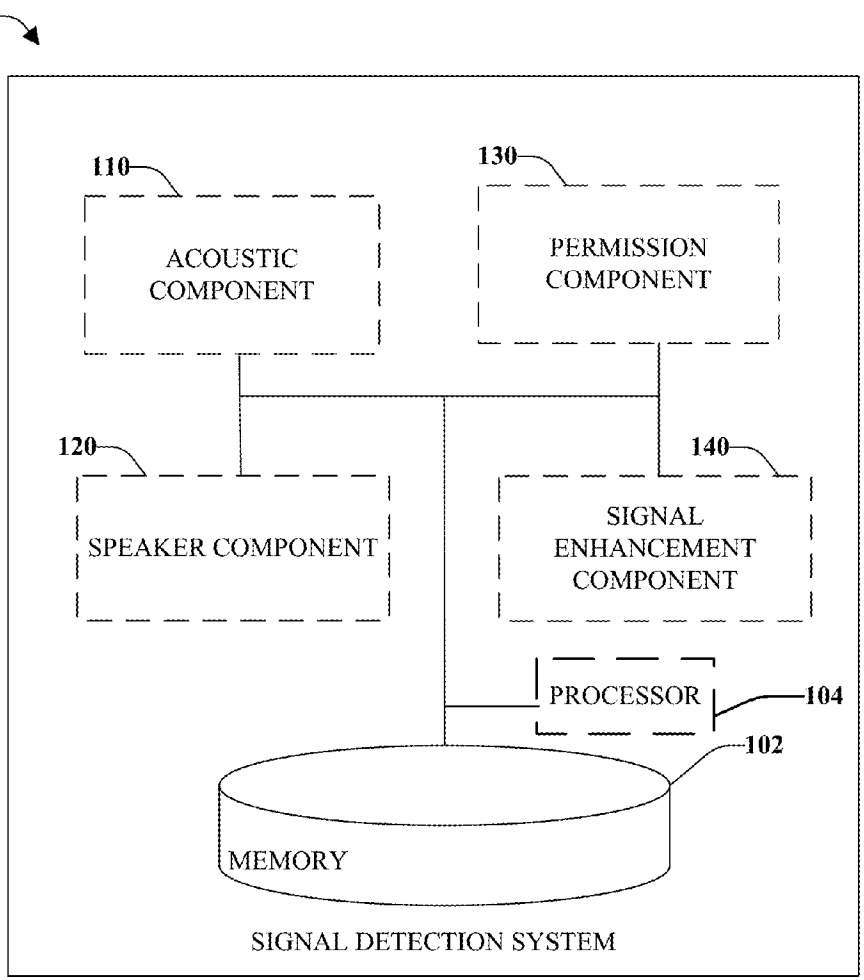
FIG. 1 illustrates an example non-limiting system and apparatus for boomless-microphone construction for wireless helmet communicator in accordance with one or more implementations.

The various embodiments are now described with reference to the drawings, wherein like reference numerals are used to refer to like elements throughout. In the following description, for purposes of explanation, numerous specific details are set forth in order to provide a thorough understanding of the various embodiments. It may be evident, however, that the various embodiments can be practiced without these specific details. In other instances, well-known structures and components are shown in block diagram form in order to facilitate describing the various embodiments.

By way of introduction, this disclosure relates to a boomless microphone device. The device can be setup within a helmet such as a motorcycle helmet to protect the microphone from interference disturbances (e.g. wind) and environmental conditions (e.g. rain, snow, etc.). The configuration within the helmet can comprise, two loudspeakers and a two-microphone array beamformer that cancels echo via a signal inversion technique also described as phase shifting. Each of the two microphones can be attached to a right and left helmet cheek-pad, whereby each cheekpad forms an effective wind filter and protective barrier to prevent weather damage to the device (e.g. damage from wet rain or snow). Furthermore, each speaker can be mounted within the right and left ear compartment, which are cavities created by the cheekpad, of the helmet.

The microphones of the device can receive siren signals emitted from emergency vehicle siren signals (e.g. police vehicle siren, ambulance siren, fire truck siren) and other warning signals (e.g. earthquake horn, fire alarm, etc.). The device can utilize digital processing techniques to detect and classify the siren signal such that each type of audio signal related to a type of siren can be identified. Furthermore, the device can estimate the distance of the object or vehicle generating the siren signal from the device as well as its relative location (e.g. northwest, southeast, etc.) in relation to the device. Thus, for instance, a user wearing a helmet comprising the device configuration can receive warning announcements of approaching emergency vehicles via the two loudspeakers.

Example System for Access to Media Content Shared Among A Social Circle

Referring now to the drawings, with reference initially to FIG. 1, boomless microphone device 100 is shown that facilitates detection of far field and near field warning signals, estimation of distance of objects generating the warning signals from the device, inhibition of interference signals, and cancellation echo noise. Aspects of the device, apparatus or processes explained in this disclosure can constitute machine-executable component embodied within machine(s), e.g., embodied in one or more computer readable mediums (or media) associated with one or more machines. Such component, when executed by the one or more machines, e.g. computer(s), computing device(s), virtual machine(s), etc. can cause the machine(s) to perform the operations described. Device 100 can include memory 102 for storing computer executable components and instructions. A processor 104 can facilitate operation of the computer executable components and instructions by device 100.

In an embodiment, device 100 employs an acoustic component 110, a speaker component 120, a permission component 130, and a signal enhancement component 140. Acoustic component 110 receives an audio signal, wherein the acoustic component 110 comprises a left acoustic sensor and a right acoustic sensor, and wherein the left acoustic sensor is mountable or attachable to the surface of a left wall of a helmet and the right acoustic sensor is mountable or attachable to the surface of a right wall of the helmet. Speaker component 120 generates an echoless audio signal via signal inversion of the audio signal, wherein the speaker component 120 outputs to a left speaker mountable or attachable to a left ear area of the helmet and a right speaker mountable or attachable to a right ear area of the helmet.

Permission component 130 permits the acoustic component 110 to receive a first audio signal determined to originate within a beam forming region and prevents the acoustic component 110 from reception of a second audio signal determined to originate outside the beam forming region, wherein the beam forming region comprises a spatial zone comprising a frontal opening of the helmet between the acoustic component 110 and the speaker component 120 and defined relative to the device, wherein the first audio signal and the second audio signal are determined to traverse the spatial zone. Signal enhancement component 140 increases an intensity of the first audio signal associated with an emergency siren based on a determined proximity of an emergency vehicle or emergency object, that produces the emergency siren, to the device.

A user wearing a helmet while operating a vehicle (e.g. a motorcycle, bicycle, off-road vehicle, etc.) may seek to utilize headset communications while operating such vehicles. Device 100 facilitates the communication by a user by providing an efficacious apparatus to send and receive audio signals. In an embodiment, device 100 employs an acoustic component 110 comprising a left acoustic sensor and a right acoustic sensor, wherein the left acoustic sensor is mountable or attachable to the surface of a right wall of a helmet. The left and right acoustic sensor can be a microphone whereby the left microphone can be mounted or attached to the surface of the left wall of the helmet and the right acoustic sensor can be attachable or mountable to the right wall of the helmet.

Figure 1A:
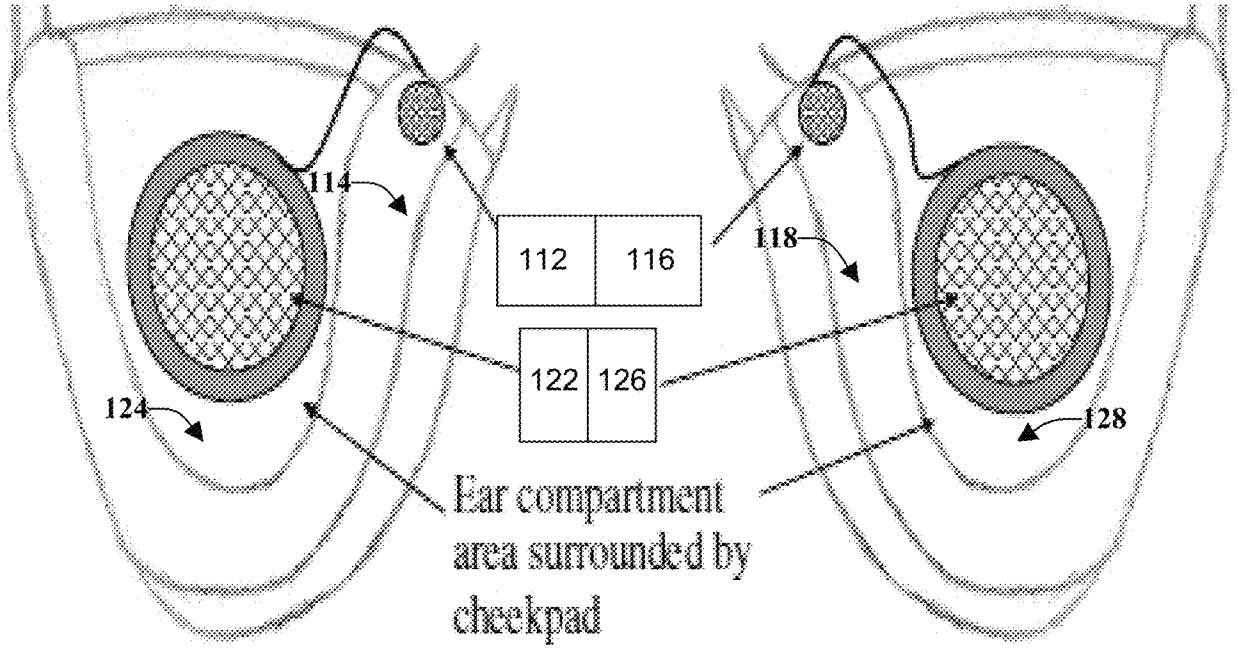
FIG. 1A illustrates an example non-limiting device for boomless-microphone construction for wireless helmet communicator in accordance with one or more implementations.

Turning to FIG. 1A, illustrated is a left acoustic sensor 112 mounted at the surface of the left wall 114 of the helmet. Also illustrated in FIG. 1A is a right acoustic sensor 116 mounted at the surface of the right wall 118 of the helmet. In an aspect, the right wall 118 and left wall 114 of the helmet can be a right cheekpad and left cheekpad of the helmet. The placement of the left acoustic sensor 112 and right acoustic sensor 116 protects both microphones from damaging weather conditions such as rain, snow, sleet, hail and other natural conditions that can damage such electrical equipment. Furthermore, in an aspect, the placement of the right acoustic sensor 116 and left acoustic sensor 112 can protect the microphones from receiving disturbing interference signals such as wind.

Also, in an aspect, mounting the acoustic sensor on the left wall 114 and right wall 118 (e.g. within a cheekpad of a helmet) allows the acoustic sensor to receive clear speech signals from the user even where a helmet visor is open or while the vehicle is moving at a fast speed while the user is speaking. Thus the user voice can be received clearly via the acoustic sensors while the signal interference (e.g. wind noise) is blocked via the right wall 118 and left wall 114 (e.g. helmet cheekpad).

In an aspect, the acoustic component 110 is designed to receive a far field audio signal and a near field audio signal. For instance, whereby a user is travelling via a motorcycle while wearing a helmet with device 100 attached to the helmet, the user can speak freely and acoustic component 110 can receive the audio signal from the user voice. Furthermore, acoustic component 110 can simultaneously receive a far-field audio signal, such as a siren signal emitted from a police vehicle. In an aspect device 100 can warn the user of approaching emergency vehicles as the user is talking on the phone or listening to a song thus providing an alert to the user.

In another aspect, device 100 employs speaker component 120 that generates an echoless audio signal via signal inversion of the audio signal, wherein the speaker component 120 outputs to a left speaker 122 mountable or attachable to a left ear area 124 of the helmet and a right speaker 126 mountable or attachable to a right ear area 128 of the helmet. As illustrated in FIG. 1A, the left ear area 122 and right ear area 128 of the helmet are cavities created by the raised left wall 114 and raised right wall 118 of the helmet. By mounting or attaching the left speaker 122 and right speaker 126 to the left ear area 124 and right ear area 128 cavities respectively, the two speakers are located a sufficient distance from the acoustic component 110. The distance created between the location of the acoustic component 110 and speaker component 120 enables the acoustic component 110 to receive weak siren signals by any emergency vehicles.

Furthermore, in an aspect, permission component 130 permits the acoustic component 110 to receive a first audio signal determined to originate within a beam forming region and prevents the acoustic component from reception of a second audio signal determined to originate outside the beam forming region, wherein the beam forming region comprises a spatial zone comprising a frontal opening of the helmet between the acoustic component and the speaker component and defined relative to the device, wherein the first audio signal and the second audio signal are determined to traverse the spatial zone. In an aspect, the placement of the acoustic component 110 attached to the respective helmet walls and the placement of the speaker component 120 mounted to the respective ear areas of the helmet create a beam forming region with the frontal portion of the helmet.

The configuration of the left acoustic sensor 112 mounted at the surface of the left wall 114 of the helmet, the right acoustic sensor 116 mounted at the surface of the right wall 118 of the helmet, the left speaker 122 mounted to the left ear area 124, the right speaker 126 mounted to the right ear area 128, and the space comprising the frontal region of the helmet creates a beam forming region. The beam-forming region is an area within which audio signals travel. The device 100 employs permission component 130 to permit acoustic component 110 to receive, in a selective manner, a first audio signal determined to originate within the spatial zone bounded by the beam forming region (e.g. bounded by the acoustic component 110, speaker component 120, and frontal portion of the helmet).

Wherein the permission component 130 determines whether to permit or deny the receipt of an audio signal depends on the determination of the origination of the audio signal. In an aspect, a first audio signal can originate outside the beam forming region but be determined by permission component 130 to originate within the beam forming region. For instance, a weak audio signal generated from a fire truck siren located a far distance from the beam forming region can be determined by permission component 130 to originate within the beam forming zone and thereby the siren signal can be received by acoustic component 130.

By selectively determining which audio signals are deemed to originate within the beam forming region and outside the beam forming region, permission component 130 can create acoustic echo cancellation to eliminate unwanted environmental noise from being received by acoustic component 110. For instance, the permission component 130 can determine an interference signal from the wind to originate outside of the beam forming region and the audio signal from a users speech to originate within the beam forming region thereby permitting the acoustic component 110 to receive the audio signal from the users speech but prevent the receipt of the audio interference signal from the wind.

In another aspect, speaker component 120 generates an echoless audio signal via signal inversion of the audio signal. The signal inversion, also referred to as phase inversion, is a mechanism to produce sound waves out of phase from the left speaker 122 and the right speaker 126. In an aspect, phase inversion allows the permission component 130 to generate artificial information within the beam forming to indicate that the sound source or audio signal is not generated from within the beam-forming region. Thus permission component 130 by generating artificial information can separate audio signals to suppress (e.g. interference signals) or audio signals to permit (e.g. emergency vehicle warning audio signals) for receipt by the acoustic component 110.

In an aspect, permission component 130 can achieve signal inversion by employing software, hardware, or software in combination with hardware to facilitate signal inversion techniques. For instance, the left speaker 122 and the right speaker 126 can be wired (e.g. hardware) in the opposite orientation to produce sound waves out of phase and create a mono signal. The detailed description and implementation of implementation of 'signal inversion' can be found in U.S. patent application Ser. No. 11/420,768 referred to as "System and Apparatus for Wireless Communications with Acoustic Echo Control and Noise Cancellation", filed on May 29, 2006, which is herein incorporated by reference.

In another aspect, device 100 can employ signal enhancement component 140. In an aspect, signal enhancement component 140 can increase an intensity of the first audio signal associated with an emergency siren based on a determined proximity of an emergency vehicle or emergency object, that produces the emergency siren, to the device. The increasing of an audio signal intensity can warn the user, riding a motorcycle or other vehicle, of an approaching emergency vehicle. For instance, as a police car approaches the device 100 (e.g. located in the user helmet), signal enhancement component 140 can increase the relative intensity of the siren noise, thereby alerting the user that the police vehicle is approaching closer. Also, in an aspect, signal enhancement component 140 can increase the intensity of the siren noise via a left speaker or a right speaker depending on from which side of the device 100 the emergency vehicle is approaching. For example, wherein the emergency vehicle is approaching on the right side of the device 100, the signal intensity can increase in loudness (e.g. via signal enhancement component 140), relative to the left speaker loudness, via the right speaker. Thus, the relative intensity between the left speaker and right speaker, of the audio output, can indicate the relative position of the emergency vehicle or object generating the warning noise, with respect to the user or device.

Figure 2:
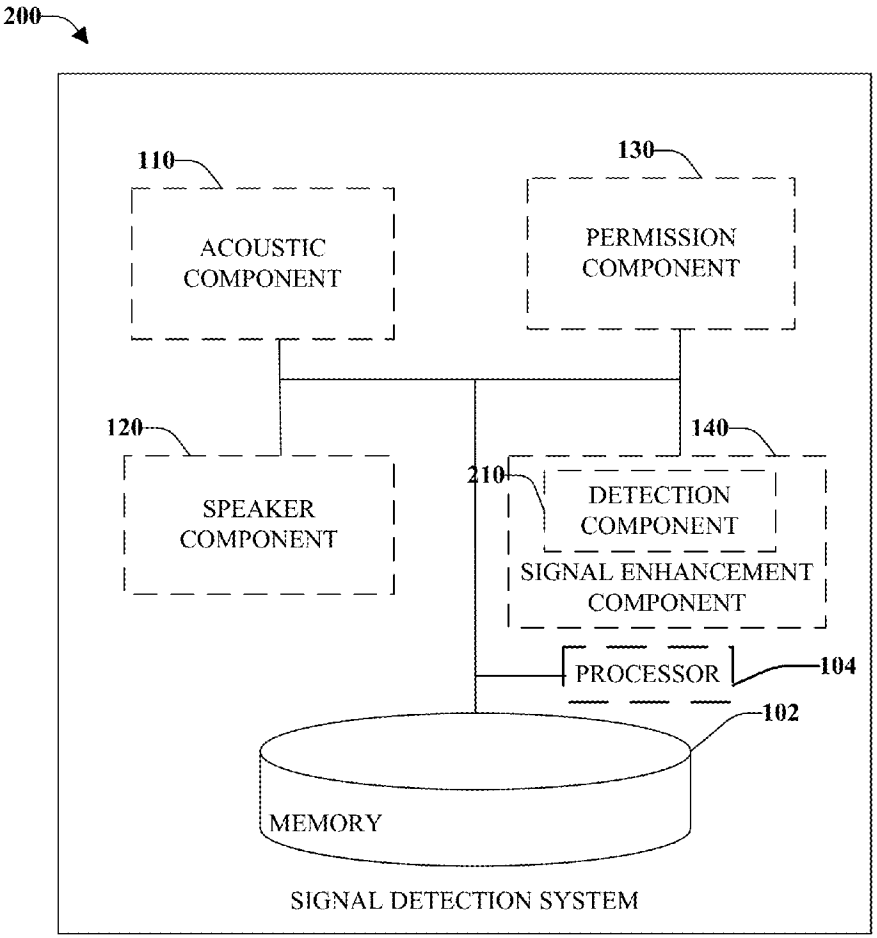
FIG. 2 illustrates an example non-limiting device for boomless-microphone construction for wireless helmet communicator with siren signal detection and classification capability in accordance with one or more implementations.

With reference to FIG. 2, presented is another exemplary non-limiting embodiment of device 200 in accordance with the subject disclosure. In an aspect, device 200 further comprises detection component 210, employed by signal enhancement component 140, that detects the first audio signal associated with the emergency siren. The detection component 210 can discern between audio information signals based on audio signal patterns, thresholds, and other distinguishing characteristics of audio signals. By distinguishing between various audio signals, detection component 210 can identify an audio signal as a signal of a warning noise, emergency vehicle or siren in order to allow device 200 to process the audio signal and warn the user via enhancing the intensity of the audio signal (e.g. by using signal enhancement component 140).

Figure 3:
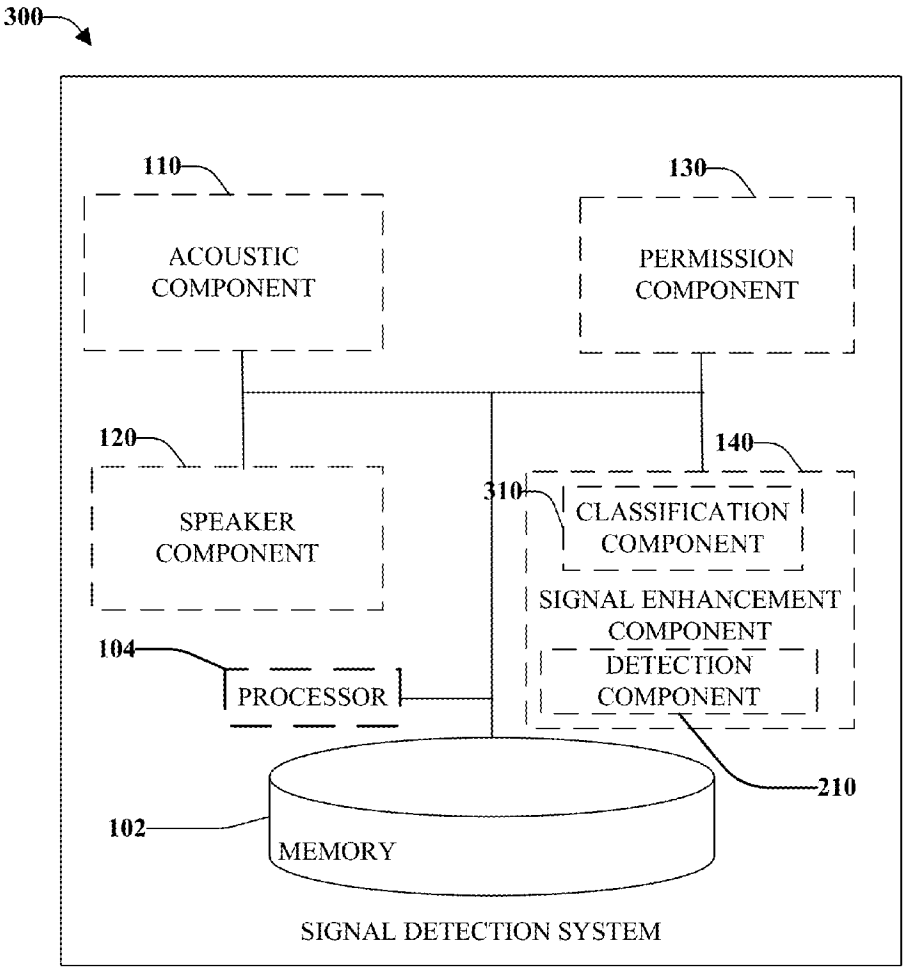
FIG. 3 illustrates an example non-limiting illustrates an example non-limiting device for boomless-microphone construction for wireless helmet communicator with siren signal detection and classification capability in accordance with one or more implementations.

With reference to FIG. 3, presented is another exemplary non-limiting embodiment of device 300 in accordance with the subject disclosure. In an aspect, device 300 with the addition of classification component 310, employed by signal enhancement component 140, classifies the first audio signal associated with the emergency siren. By classifying the audio signal associated with the emergency siren, speaker component 120 in connection with signal enhancement component 140 can increase the intensity of an audio signal and simultaneously warn the user of the particular object associated with the warning. For instance, whereby detection component 210 detects a siren audio signal, classification component 310 can classify the signal as a fire truck siren, and signal enhancement component 140 can increase the signal intensity of the audio signal via speaker component 120. Furthermore, device 300 can issue a vocal warning to the user mentioning the type of siren associated with the audio signal (e.g. fire truck), so the user can keep aware of approaching emergency vehicles such as fire trucks.

Figure 4:
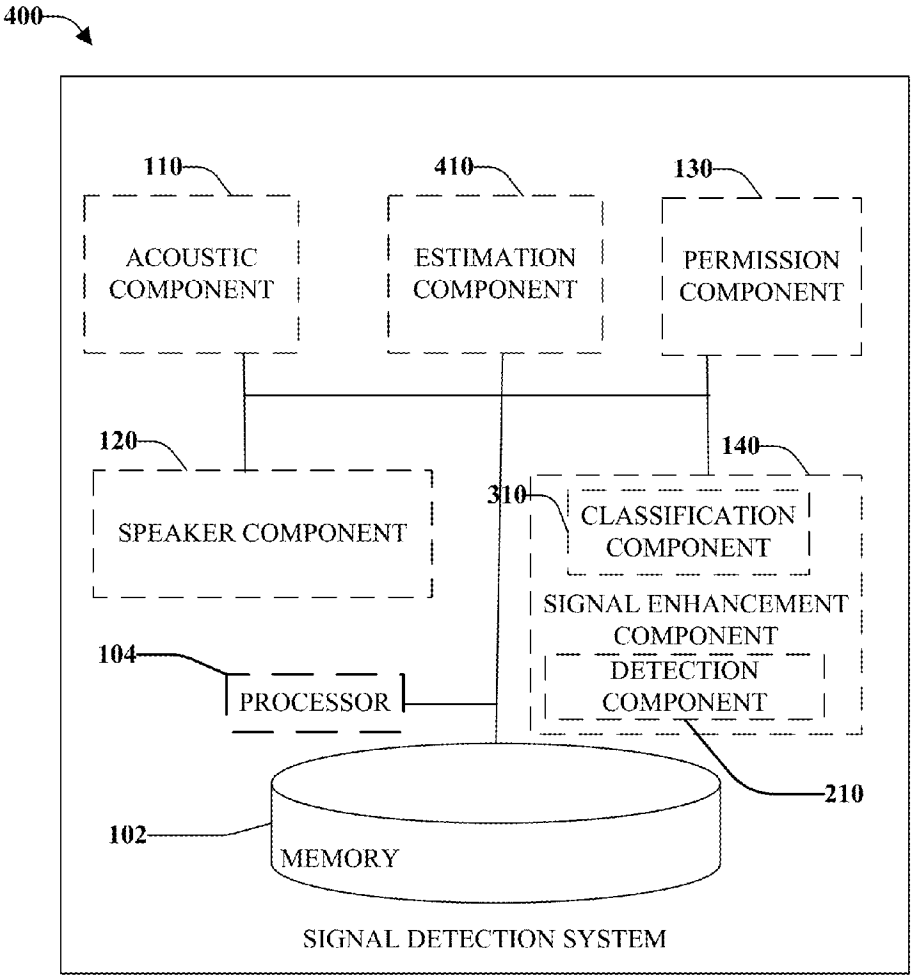
FIG. 4 illustrates an example non-limiting illustrates an example non-limiting device for boomless-microphone construction for wireless helmet communicator with siren signal detection and classification capability in accordance with one or more implementations.

With reference to FIG. 4, presented is another exemplary non-limiting embodiment of device 400 in accordance with the subject disclosure. In an aspect, device 400 with the addition of estimation component 410 estimates a distance of the first audio signal associated with the emergency siren from the device by comparing an estimate of the intensity of the first audio signal to a signal intensity reference value. The first audio signal is an audio signal determined to originate (e.g. by using permission component 130) within the beam-forming region and is thereby received by acoustic component 110. In an instance, the first audio signal can be a warning signal or audio signal associated with an emergency vehicle siren.

In an aspect, estimation component 410 can estimate a distance of the first audio signal associated with the emergency siren from the device by comparing an estimate of the intensity of the first audio signal to a signal intensity reference value. By estimating the relative distance of the emergency vehicle or emergency object, estimation component 410 in connection with processor 104 can process data related to the distance of objects in relation to the device. Further, the proximity information can be used to warn (e.g. via warning component 510) a user of approaching emergency vehicles.

Figure 5:
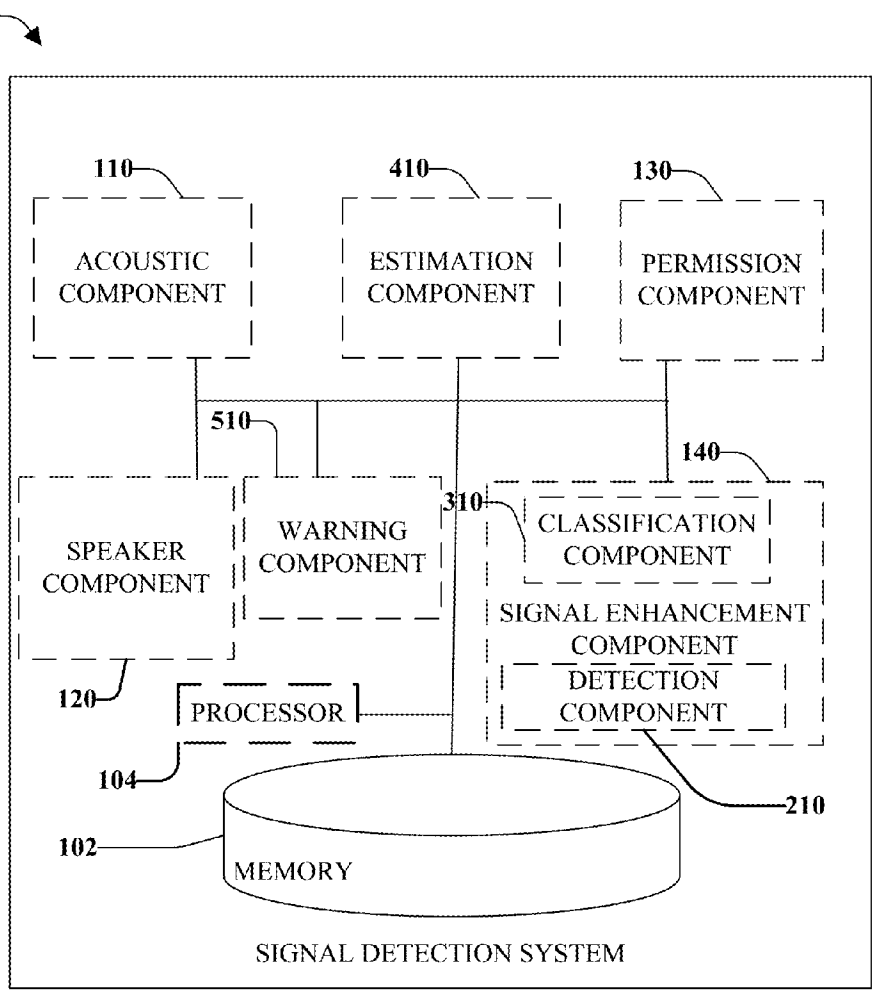
FIG. 5 illustrates an example non-limiting illustrates an example non-limiting device for boomless-microphone construction for wireless helmet communicator with siren signal detection and classification capability in accordance with one or more implementations.

With reference to FIG. 5, presented is another exemplary non-limiting embodiment of device 500 in accordance with the subject disclosure. In an aspect, device 500 further comprises warning component 510 that deploys a warning signal in connection with speaker component 120 to indicate a proximity range of the emergency siren from the device. In an aspect, warning component 510 can deploy a warning signal via an announcement to indicate to the user the proximity of an approaching emergency vehicle or object producing a siren. Furthermore, in an aspect, the warning announcement can communicate a degree of warning based on the imminence of the potential danger.

For instance, warning component 510 can deploy a loud announcement if an emergency vehicle is very near to device 500. Alternatively, warning component 510 can deploy a softer warning whereby the emergency vehicle is located very far from device 500 thereby indicating the level of danger to the user is relatively low. In another aspect, the warning component 510 can deploy a number of different warnings based on the type of emergency siren. Thus, a warning can alert the device 500 user of the type of emergency vehicle or emergency scenario associated with the siren signal. For instance, warning signal can deploy a different announcement for a fire engine siren, police siren, earthquake siren, ambulance siren, and other such siren signals.

Figure 6:
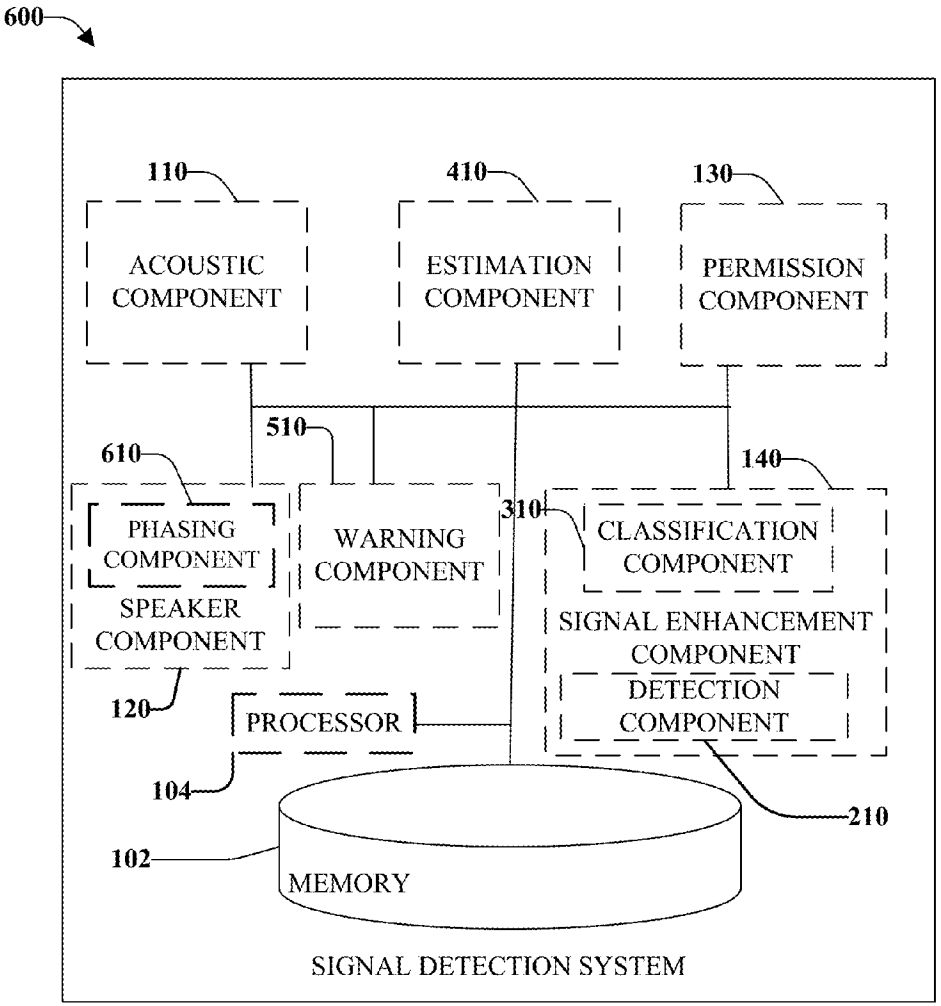
FIG. 6 illustrates an example non-limiting illustrates an example non-limiting device for boomless-microphone construction for wireless helmet communicator with siren signal detection and classification capability in accordance with one or more implementations.

With reference to FIG. 6, presented is another exemplary non-limiting embodiment of device 600 in accordance with the subject disclosure. In an aspect, device 600 further comprises phasing component 610, employed by speaker component 120, that produces a first sound wave from the left speaker out of phase with a second sound wave from the right speaker to inhibit an echo sound associated with the first audio signal. In an aspect, phasing component 610 in connection with permission component 130, can create a phase shift, via signal inversion or phase shifting, significant enough such that the sound source or signal source appears to originate outside the beam-forming region. Thus, the permission component 130 can deny the acoustic component 110 from receipt of the sound (e.g. echo) or audio signal due to its appeared origination outside the beam-forming region.

Furthermore, the phasing component 160, in connection with software employed by device 600, can apply signal inversion techniques to digital signals via stereo channels by delaying the audio sample in one channel with respect to the audio signal of another channel. In another aspect, device 600 in connection with phasing component 160 can employ one or more resistor-capacitor circuit to achieve signal inversion via analog audio signals. In an aspect, phasing component 160 can employ the resistor-capacitor circuit so that the phases of the audio signals output from the speaker component 120 are inversed as to not be received by acoustic component 110, thereby resulting in echo control. Furthermore, in an aspect, phasing component 160 can inverse the phases.

Figure 7:
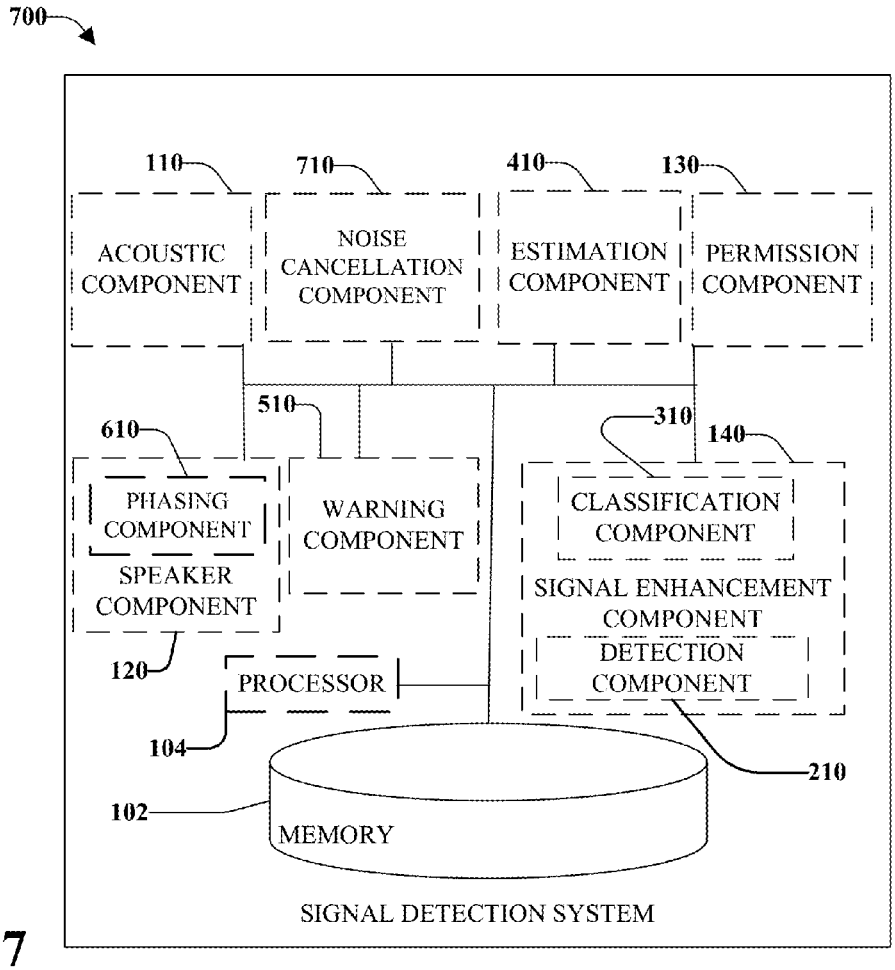
FIG. 7 illustrates an example non-limiting illustrates an example non-limiting device for boomless-microphone construction for wireless helmet communicator with siren signal detection and classification capability in accordance with one or more implementations.

With reference to FIG. 7, presented is another exemplary non-limiting embodiment of device 700 in accordance with the subject disclosure. In an aspect, device 700 further comprises noise cancellation component 710 that cancels environmental noise related to the first audio signal. In an aspect, noise cancellation component 710 can suppress noise adaptively by enhancing the signal to noise ration (SNR) of a users speech, in connection with acoustic component 110, to produce a clear signal with minimum noise. The clear signal can be received by a different user also using a device 700 or other communication device in order to facilitate a clear dialogue between users. Furthermore, noise cancellation component 710 is efficacious as utilized by a user riding a vehicle, such as a motorcycle, whereby there is a need to cancel noise while travelling or riding.

Figure 8:
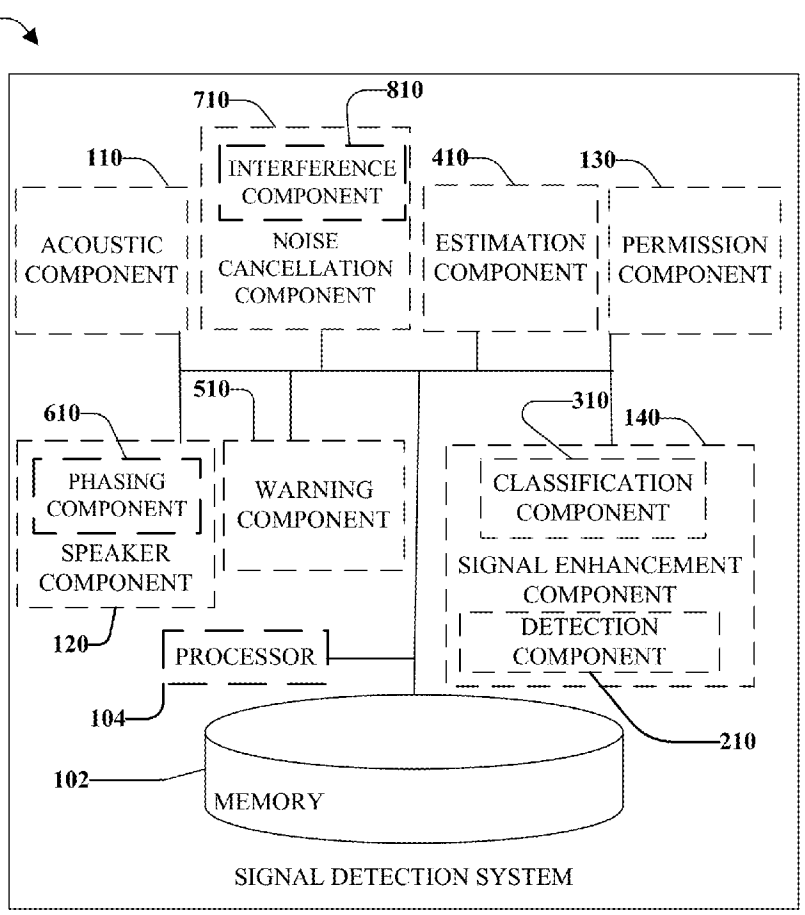
FIG. 8 illustrates an example non-limiting illustrates an example non-limiting device for boomless-microphone construction for wireless helmet communicator with siren signal detection and classification capability in accordance with one or more implementations.

With reference to FIG. 8, presented is another exemplary non-limiting embodiment of device 800 in accordance with the subject disclosure. In an aspect, device 800 further comprises interference component 810, employed by noise cancellation component 710 that inhibits directional interference signals. In an aspect, noise cancellation component can inhibit directional interference signals from environmental disturbances such as wind, thunder, and turbulent air. Furthermore, in an aspect, interference component 810 can inhibit other such directional interference noise such as noise from the engine of a motorcycle or other motor vehicle.

FIGS. 9-13 illustrates a methodology or flow diagram in accordance with certain aspects of this disclosure. While, for purposes of simplicity of explanation, the methodologies are shown and described as a series of acts, the disclosed subject matter is not limited by the order of acts, as some acts may occur in different orders and/or concurrently with other acts from that shown and described herein. For example, those skilled in the art will understand and appreciate that a methodology can alternatively be represented as a series of interrelated states or events, such as in a state diagram. Moreover, not all illustrated acts may be required to implement a methodology in accordance with the disclosed subject matter. Additionally, it is to be appreciated that the methodologies disclosed in this disclosure are capable of being stored on an article of manufacture to facilitate transporting and transferring such methodologies to computers or other computing devices.

Figure 9:
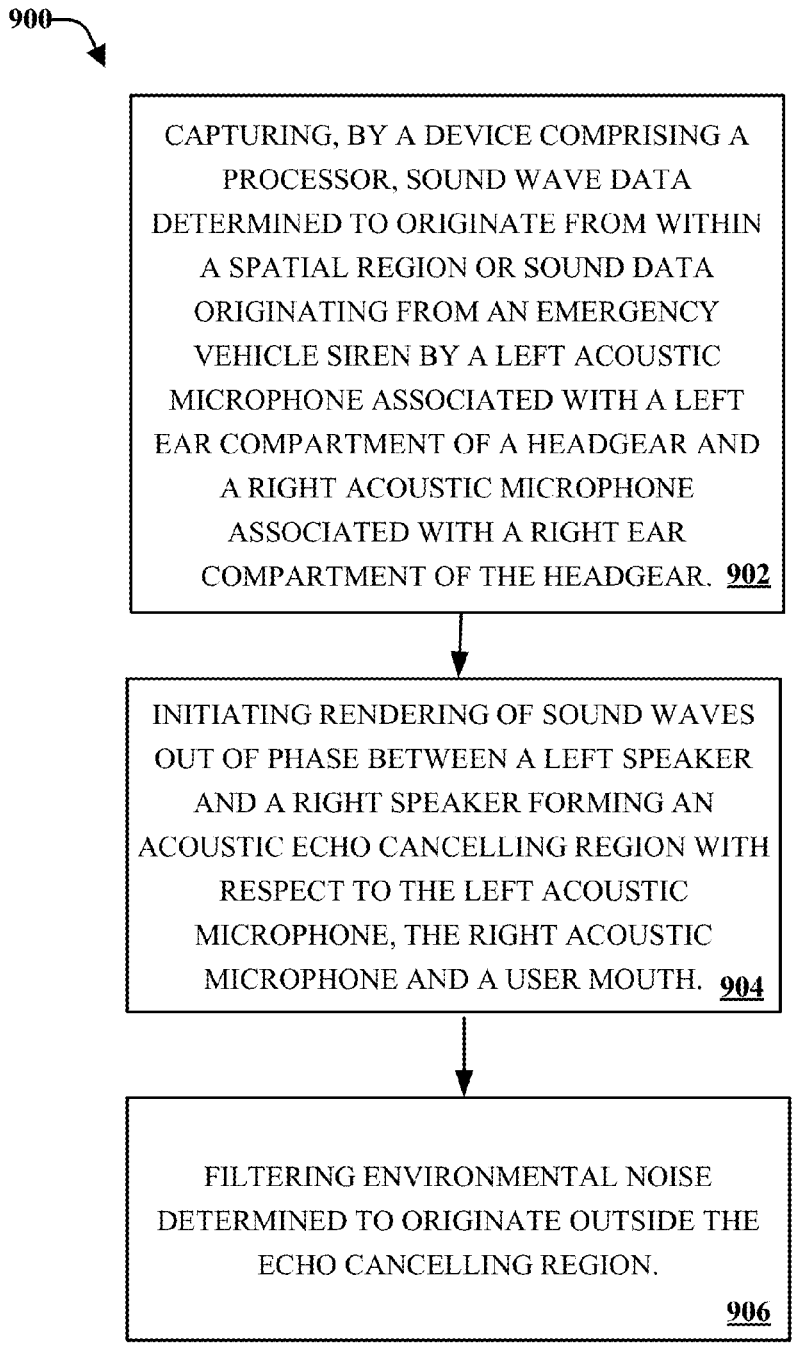
FIG. 9 illustrates an example methodology for capturing sound wave data, initiating a rendering of sound waves and filtering environmental noise in accordance with one or more implementations.

Referring now to FIG. 9, presented is a flow diagram of an example application of systems disclosed in this description in accordance with an embodiment. In an aspect, exemplary methodology 900 of the disclosed systems is stored in a memory and utilizes a processor to execute computer executable instructions to perform functions. At 902, sound wave data determined to originate from within a spatial region or sound data originating from an emergency vehicle siren is captured, by a device comprising a processor, by a left acoustic microphone associated with a left ear compartment of a headgear and a right acoustic microphone associated with a right ear compartment of the headgear. At 904, a rendering of sound waves out of phase between a left speaker and a right speaker is initiated, forming an acoustic echo cancelling region with respect to the left acoustic microphone, the right acoustic microphone and a user mouth. At 906, environmental noise determined to originate outside the echo cancelling region is filtered.

Figure 10:
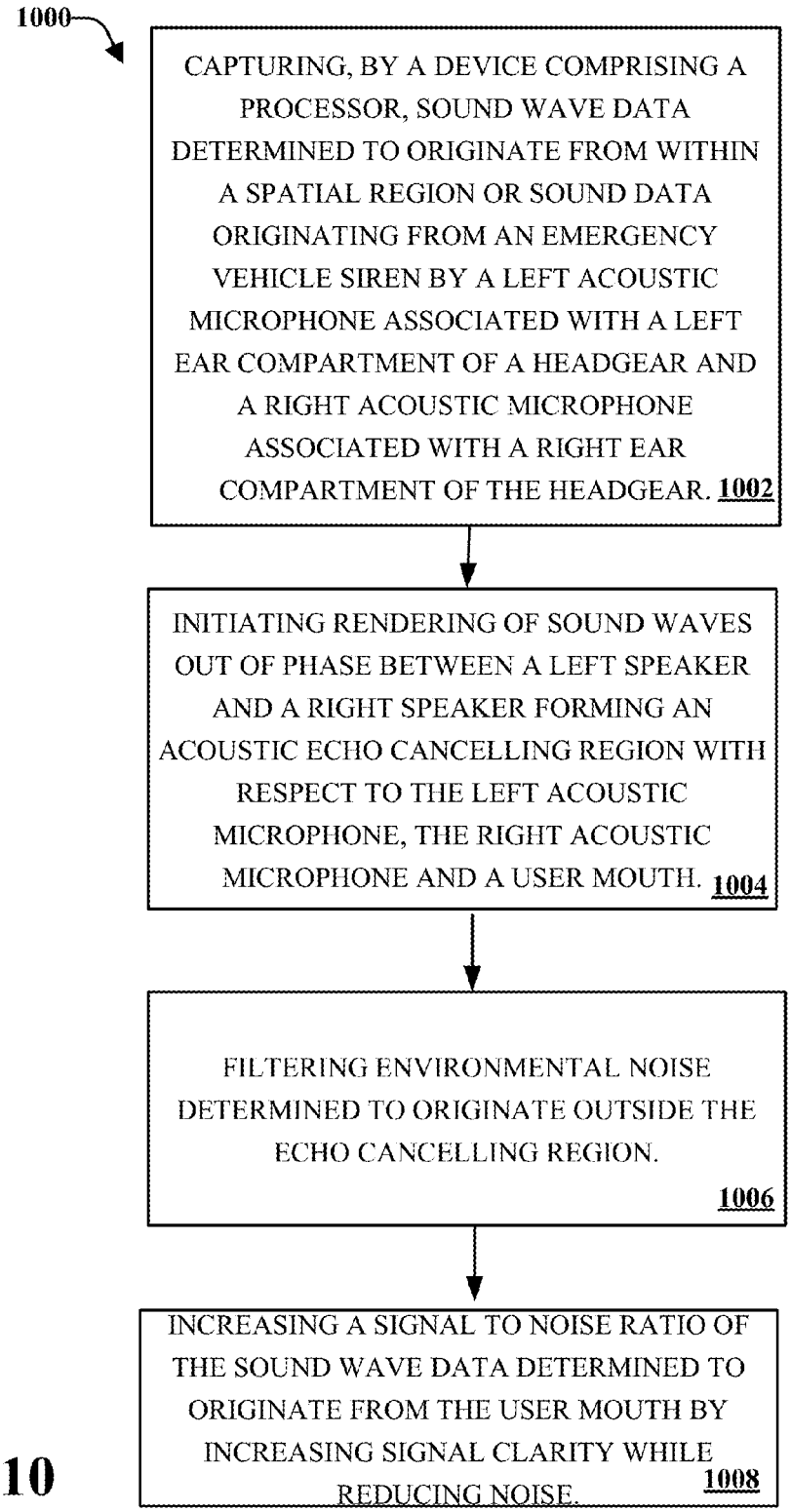
FIG. 10 illustrates an example methodology for capturing sound wave data, initiating a rendering of sound waves and filtering environmental noise, and increasing a signal to noise ratio of the sound wave data in accordance with one or more implementations.

Referring now to FIG. 10, presented is a flow diagram of an example application of systems disclosed in this description in accordance with an embodiment. In an aspect, exemplary methodology 1000 of the disclosed systems is stored in a memory and utilizes a processor to execute computer executable instructions to perform functions. At 1002, sound wave data determined to originate from within a spatial region or sound data originating from an emergency vehicle siren is captured, by a device comprising a processor, by a left acoustic microphone associated with a left ear compartment of a headgear and a right acoustic microphone associated with a right ear compartment of the headgear. At 1004, a rendering of sound waves out of phase between a left speaker and a right speaker is initiated, forming an acoustic echo cancelling region with respect to the left acoustic microphone, the right acoustic microphone and a user mouth. At 1006, environmental noise determined to originate outside the echo cancelling region is filtered. At 1008, a signal to noise ratio of the sound wave data determined to originate from the user mouth is increased by increasing signal clarity while reducing noise.

Figure 11:
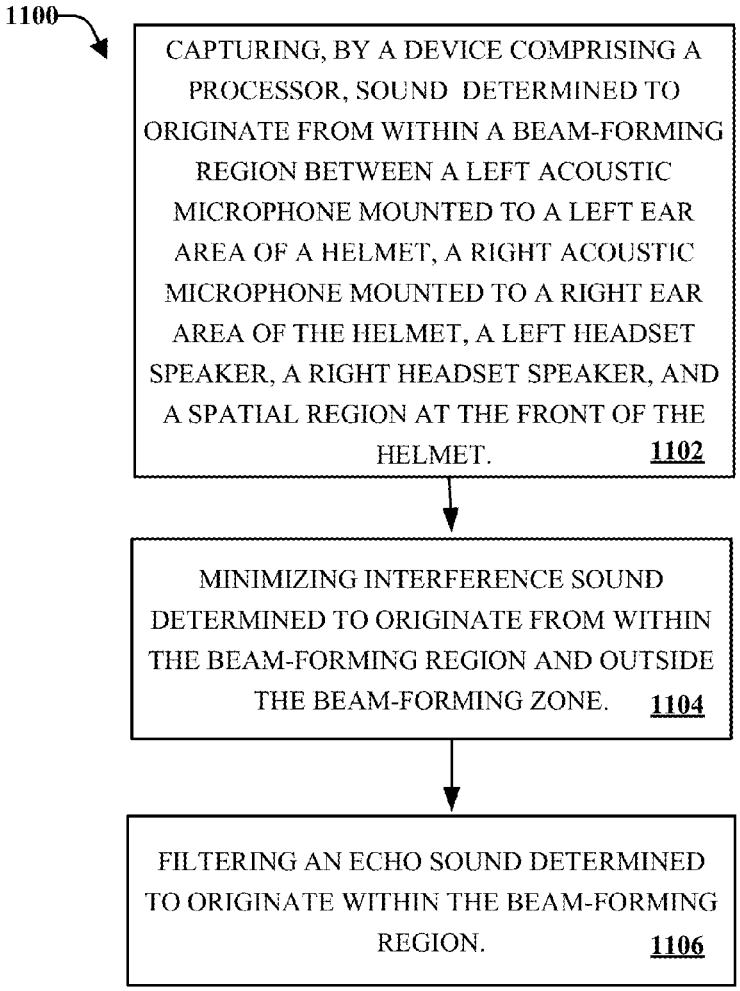
FIG. 11 illustrates an example methodology for capturing sound wave data, initiating a rendering of sound waves and filtering environmental noise, and increasing a signal to noise ratio of the sound wave data in accordance with one or more implementations.

Referring now to FIG. 11, presented is a flow diagram of an example application of systems disclosed in this description in accordance with an embodiment. In an aspect, exemplary methodology 1100 of the disclosed systems is stored in a memory and utilizes a processor to execute computer executable instructions to perform functions. At 1102, sound determined to originate from within a beam-forming region is captured between a left acoustic microphone mounted to a left ear area of a helmet, a right acoustic microphone mounted to a right ear area of the helmet, a left headset speaker, a right headset speaker, and a spatial region at the front of the helmet. At 1104, interference sound determined to originate from within the beam-forming region and outside the beam-forming zone is minimized. At 1106, an echo sound determined to originate within the beam-forming region is filtered.

Figure 12:
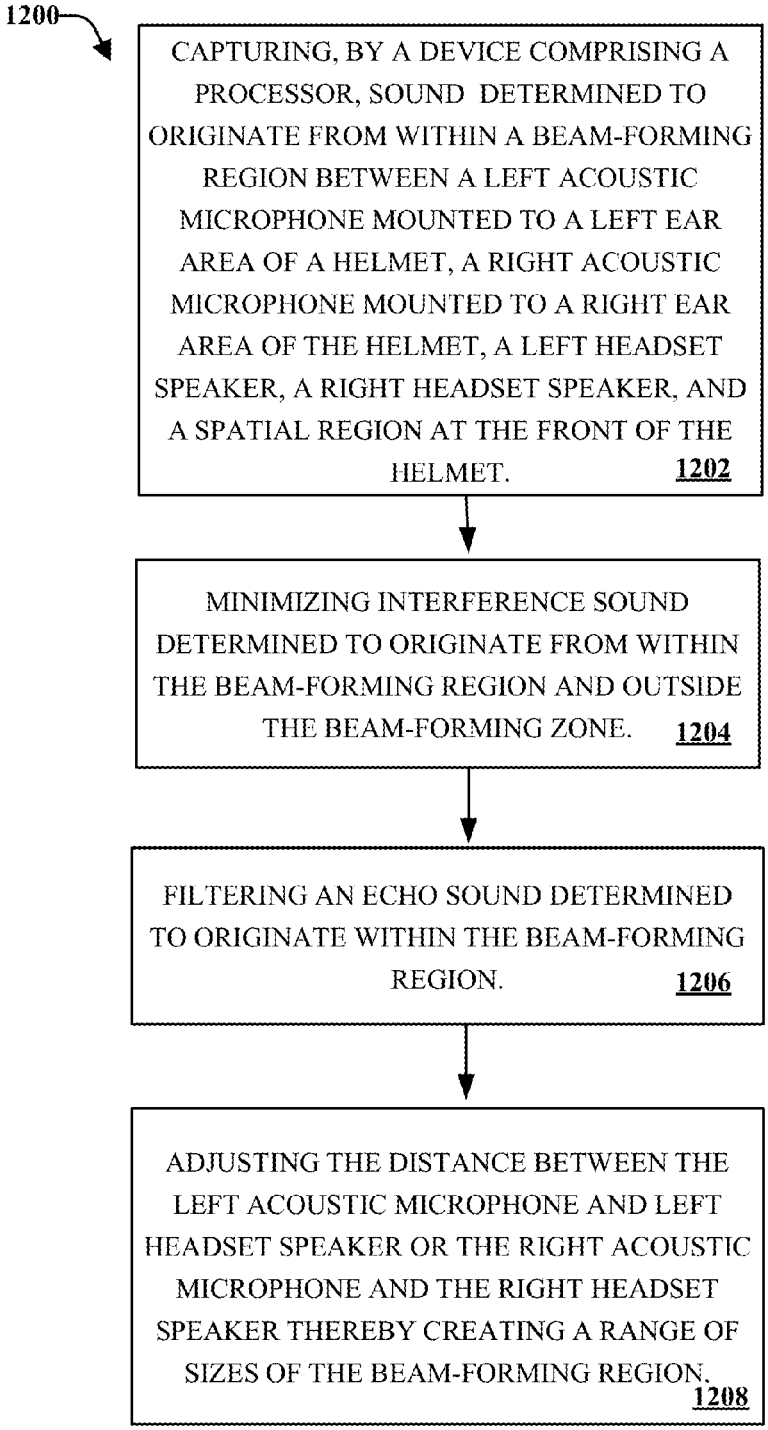
FIG. 12 illustrates an example methodology for capturing sound determined of originate from within a beam-forming region in accordance with one or more implementations.

Referring now to FIG. 12, presented is a flow diagram of an example application of systems disclosed in this description in accordance with an embodiment. In an aspect, exemplary methodology 1200 of the disclosed systems is stored in a memory and utilizes a processor to execute computer executable instructions to perform functions. At 1202, sound determined to originate from within a beam-forming region is captured between a left acoustic microphone mounted to a left ear area of a helmet, a right acoustic microphone mounted to a right ear area of the helmet, a left headset speaker, a right headset speaker, and a spatial region at the front of the helmet. At 1204, interference sound determined to originate from within the beam-forming region and outside the beam-forming zone is minimized. At 1206, an echo sound determined to originate within the beam-forming region is filtered. At 1208, the distance between the left acoustic microphone and left headset speaker or the right acoustic microphone and the right headset speaker is adjusted thereby creating a range of sizes of the beam-forming region.

Figure 13:
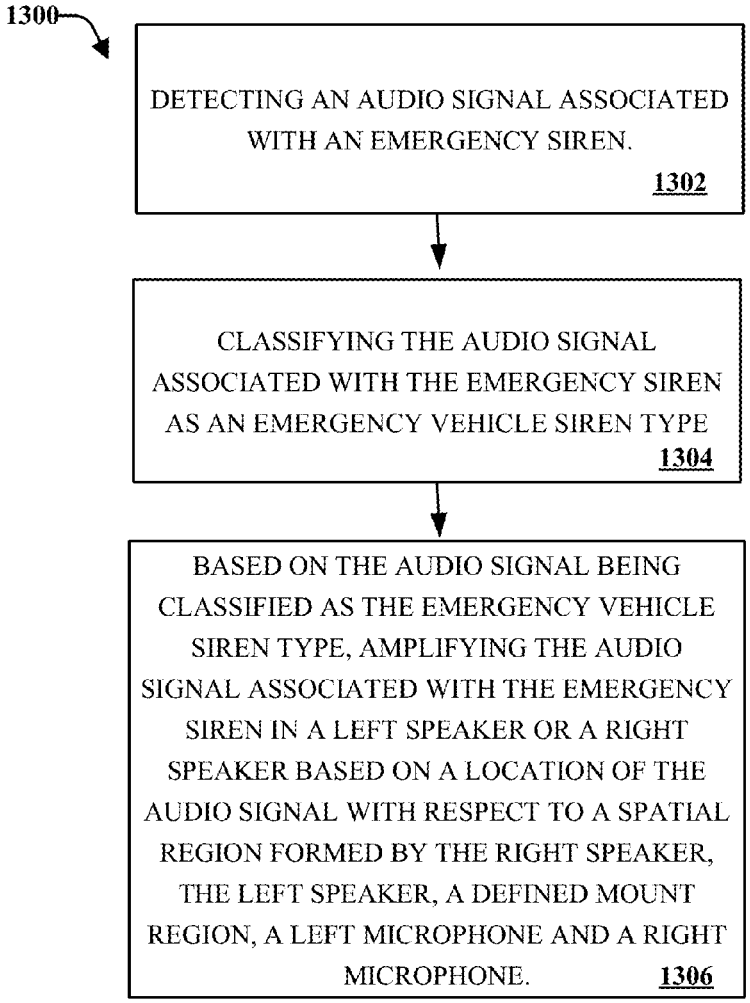
FIG. 13 illustrates an example methodology for detecting an audio signal associated with an emergency siren in accordance with one or more implementations.

Referring now to FIG. 13, presented is a flow diagram of an example application of systems disclosed in this description in accordance with an embodiment. In an aspect, exemplary methodology 1300 of the disclosed systems is stored in a memory and utilizes a processor to execute computer executable instructions to perform functions. At 1302, an audio signal associated with an emergency siren is detected. At 1304, the audio signal associated with the emergency siren as an emergency vehicle siren type is classified. At 1306, based on the audio signal being classified as the emergency vehicle siren type, the audio signal associated with the emergency siren in a left speaker or a right speaker is amplified based on a location of the audio signal with respect to a spatial region formed by the right speaker, the left speaker, a defined mouth region, a left microphone and a right microphone.

In view of the exemplary systems described above, methodologies that may be implemented in accordance with the described subject matter will be better appreciated with reference to the flowcharts of the various figures. While for purposes of simplicity of explanation, the methodologies are shown and described as a series of blocks, it is to be understood and appreciated that the claimed subject matter is not limited by the order of the blocks, as some blocks may occur in different orders and/or concurrently with other blocks from what is depicted and described in this disclosure. Where non-sequential, or branched, flow is illustrated via flowchart, it can be appreciated that various other branches, flow paths, and orders of the blocks, may be implemented which achieve the same or a similar result. Moreover, not all illustrated blocks may be required to implement the methodologies described hereinafter.

In addition to the various embodiments described in this disclosure, it is to be understood that other similar embodiments can be used or modifications and additions can be made to the described embodiment(s) for performing the same or equivalent function of the corresponding embodiment(s) without deviating there from. Still further, multiple processing chips or multiple devices can share the performance of one or more functions described in this disclosure, and similarly, storage can be effected across a plurality of devices. Accordingly, the invention is not to be limited to any single embodiment, but rather can be construed in breadth, spirit and scope in accordance with the appended claims.

Example Operating Environments

The systems and processes described below can be embodied within hardware, such as a single integrated circuit (IC) chip, multiple ICs, an application specific integrated circuit (ASIC), or the like. Further, the order in which some or all of the process blocks appear in each process should not be deemed limiting. Rather, it should be understood that some of the process blocks can be executed in a variety of orders, not all of which may be explicitly illustrated in this disclosure.

Figure 14:
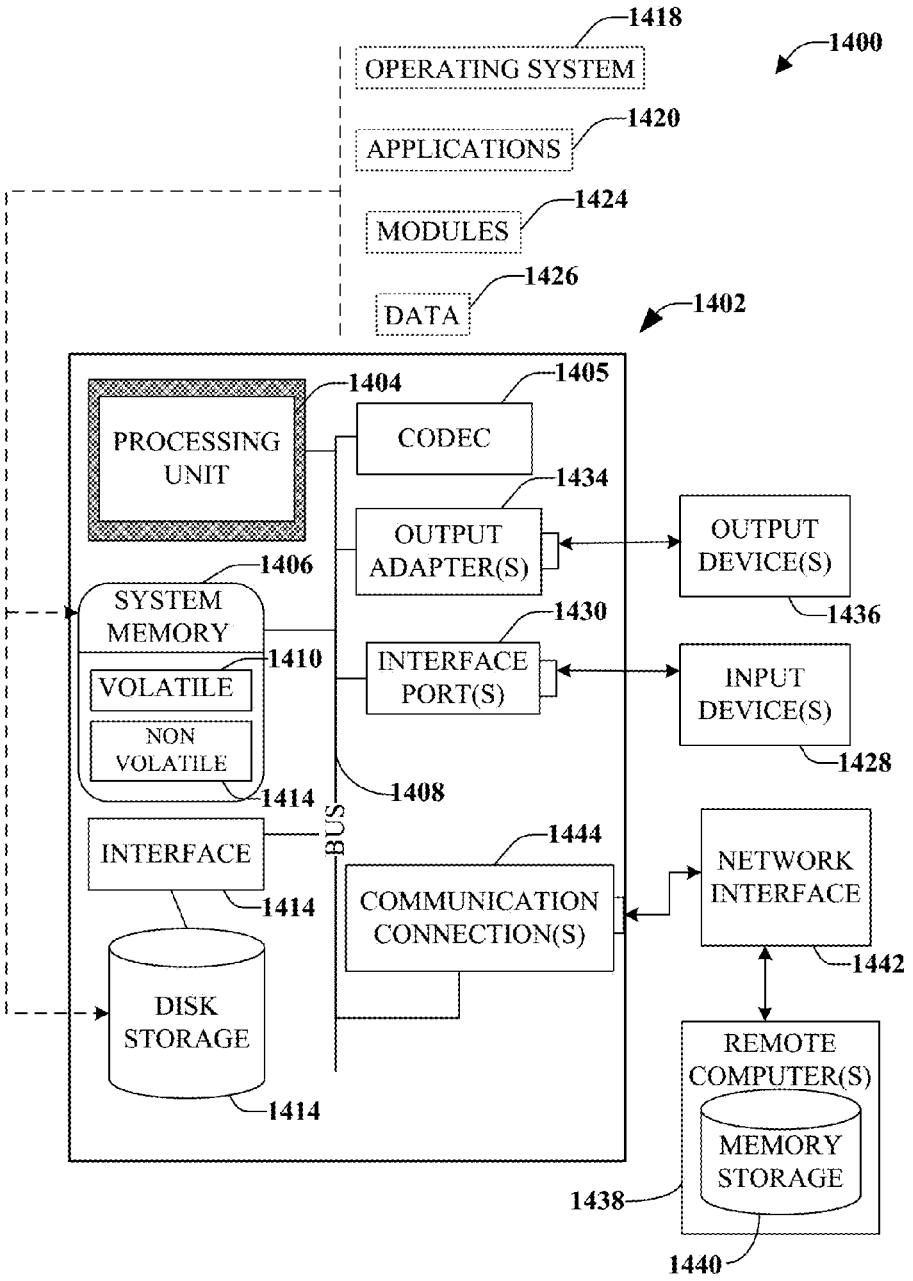
FIG. 14 is a block diagram representing an exemplary non-limiting networked environment in which the various embodiments can be implemented.

With reference to FIG. 14, a suitable environment 1400 for implementing various aspects of the claimed subject matter includes a computer 1402. The computer 1402 includes a processing unit 1404, a system memory 1406, a codec 1405, and a system bus 1408. The system bus 1408 couples system components including, but not limited to, the system memory 1406 to the processing unit 1404. The processing unit 1404 can be any of various available processors. Dual microprocessors and other multiprocessor architectures also can be employed as the processing unit 1404.

The system bus 1408 can be any of several types of bus structure(s) including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Personal Computer Memory Card International Association bus (PCMCIA), Firewire (IEEE 1394), and Small Computer Systems Interface (SCSI).

The system memory 1406 includes volatile memory 1410 and non-volatile memory 1412. The basic input/output system (BIOS), containing the basic routines to transfer information between elements within the computer 1402, such as during start-up, is stored in non-volatile memory 1412. In addition, according to various embodiments, codec 1405 may include at least one of an encoder or decoder, wherein the at least one of an encoder or decoder may consist of hardware, a combination of hardware and software, or software. Although, codec 1405 is depicted as a separate component, codec 1405 may be contained within non-volatile memory 1412. By way of illustration, and not limitation, non-volatile memory 1412 can include read only memory (ROM), programmable ROM (PROM), electrically programmable ROM (EPROM), electrically erasable programmable ROM (EEPROM), or flash memory. Volatile memory 1410 includes random access memory (RAM), which acts as external cache memory. According to present aspects, the volatile memory may store the write operation retry logic (not shown in FIG. 14) and the like. By way of illustration and not limitation, RAM is available in many forms such as static RAM (SRAM), dynamic RAM (DRAM), synchronous DRAM (SDRAM), double data rate SDRAM (DDR SDRAM), and enhanced SDRAM (ESDRAM.

Computer 1402 may also include removable/non-removable, volatile/non-volatile computer storage medium. FIG. 14 illustrates, for example, disk storage 1414. Disk storage 1414 includes, but is not limited to, devices like a magnetic disk drive, solid state disk (SSD) floppy disk drive, tape drive, Jaz drive, Zip drive, LS-70 drive, flash memory card, or memory stick. In addition, disk storage 1414 can include storage medium separately or in combination with other storage medium including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1414 to the system bus 1408, a removable or non-removable interface is typically used, such as interface 1416.

It is to be appreciated that FIG. 14 describes software that acts as an intermediary between users and the basic computer resources described in the suitable operating environment 1400. Such software includes an operating system 1418. Operating system 1418, which can be stored on disk storage 1414, acts to control and allocate resources of the computer system 1402. Applications 1420 take advantage of the management of resources by the operating system through program modules 1424, and program data 1426, such as the boot/shutdown transaction table and the like, stored either in system memory 1406 or on disk storage 1414. It is to be appreciated that the claimed subject matter can be implemented with various operating systems or combinations of operating systems.

A user enters commands or information into the computer 1402 through input device(s) 1428. Input devices 1428 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1404 through the system bus 1408 via interface port(s) 1430. Interface port(s) 1430 include, for example, a serial port, a parallel port, a game port, and a universal serial bus (USB). Output device(s) 1436 use some of the same type of ports as input device(s) 1428. Thus, for example, a USB port may be used to provide input to computer 1402, and to output information from computer 1402 to an output device 1436. Output adapter 1434 is provided to illustrate that there are some output devices 1436 like monitors, speakers, and printers, among other output devices 1436, which require special adapters. The output adapters 1434 include, by way of illustration and not limitation, video and sound cards that provide a means of connection between the output device 1436 and the system bus 1408. It should be noted that other devices and/or systems of devices provide both input and output capabilities such as remote computer(s) 1438.

Computer 1402 can operate in a networked environment using logical connections to one or more remote computers, such as remote computer(s) 1438. The remote computer(s) 1438 can be a personal computer, a server, a router, a network PC, a workstation, a microprocessor based appliance, a peer device, a smart phone, a tablet, or other network node, and typically includes many of the elements described relative to computer 1402. For purposes of brevity, only a memory storage device 1440 is illustrated with remote computer(s) 1438. Remote computer(s) 1438 is logically connected to computer 1402 through a network interface 1442 and then connected via communication connection(s) 1444. Network interface 1442 encompasses wire and/or wireless communication networks such as local-area networks (LAN) and wide-area networks (WAN) and cellular networks. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1444 refers to the hardware/software employed to connect the network interface 1442 to the bus 1408. While communication connection 1444 is shown for illustrative clarity inside computer 1402, it can also be external to computer 1402. The hardware/software necessary for connection to the network interface 1442 includes, for exemplary purposes only, internal and external technologies such as, modems including regular telephone grade modems, cable modems and DSL modems, ISDN adapters, and wired and wireless Ethernet cards, hubs, and routers.

Figure 15:
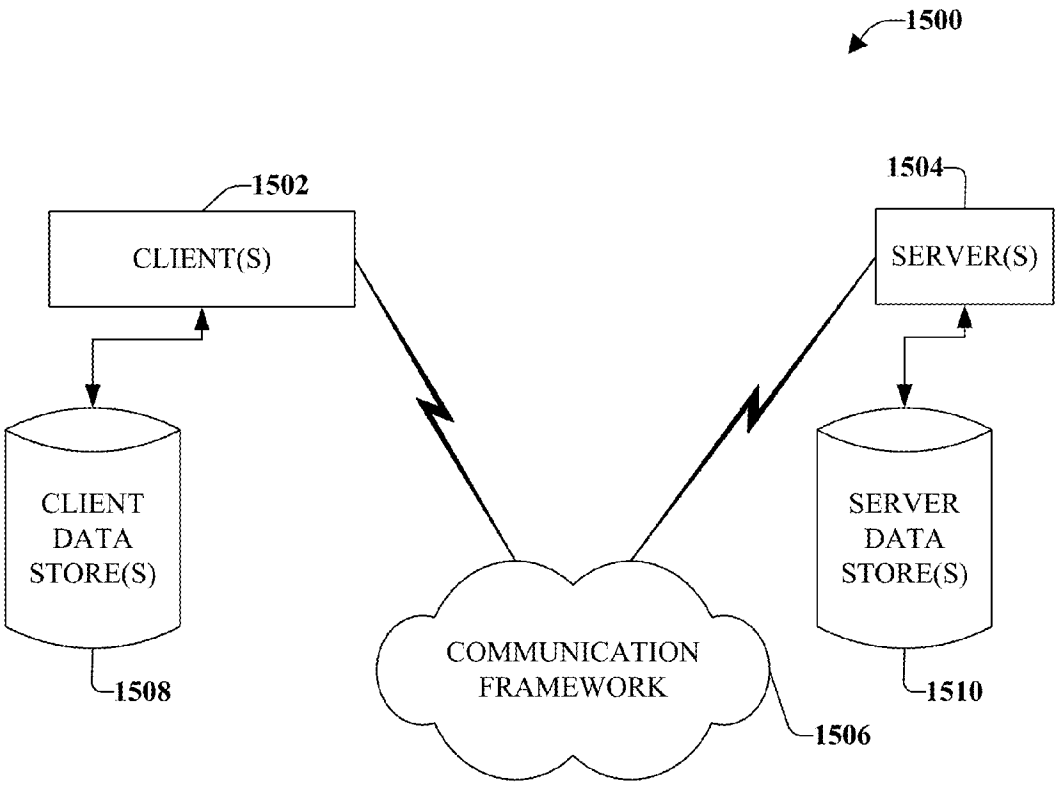
FIG. 15 is a block diagram representing an exemplary non-limiting computing system or operating environment in which the various embodiments may be implemented.

Referring now to FIG. 15, there is illustrated a schematic block diagram of a computing environment 1500 in accordance with this disclosure. The system 1500 includes one or more client(s) 1502 (e.g., laptops, smart phones, PDAs, media players, computers, portable electronic devices, tablets, and the like). The client(s) 1502 can be hardware and/or software (e.g., threads, processes, computing devices). The system 1500 also includes one or more server(s) 1504. The server(s) 1504 can also be hardware or hardware in combination with software (e.g., threads, processes, computing devices). The servers 1504 can house threads to perform transformations by employing aspects of this disclosure, for example. One possible communication between a client 1502 and a server 1504 can be in the form of a data packet transmitted between two or more computer processes wherein the data packet may include video data. The data packet can include a metadata, such as associated contextual information for example. The system 1500 includes a communication framework 1506 (e.g., a global communication network such as the Internet, or mobile network(s)) that can be employed to facilitate communications between the client(s) 1502 and the server(s) 1504.

Communications can be facilitated via a wired (including optical fiber) and/or wireless technology. The client(s) 1502 include or are operatively connected to one or more client data store(s) 1508 that can be employed to store information local to the client(s) 1502 (e.g., associated contextual information). Similarly, the server(s) 1504 are operatively include or are operatively connected to one or more server data store(s) 1510 that can be employed to store information local to the servers 1504.

In one embodiment, a client 1502 can transfer an encoded file, in accordance with the disclosed subject matter, to server 1504. Server 1504 can store the file, decode the file, or transmit the file to another client 1502. It is to be appreciated, that a client 1502 can also transfer uncompressed file to a server 1504 and server 1504 can compress the file in accordance with the disclosed subject matter. Likewise, server 1504 can encode video information and transmit the information via communication framework 1506 to one or more clients 1502.

The illustrated aspects of the disclosure may also be practiced in distributed computing environments where certain tasks are performed by remote processing devices that are linked through a communications network. In a distributed computing environment, program modules can be located in both local and remote memory storage devices.

Moreover, it is to be appreciated that various components described in this description can include electrical circuit(s) that can include components and circuitry elements of suitable value in order to implement the various embodiments. Furthermore, it can be appreciated that many of the various components can be implemented on one or more integrated circuit (IC) chips. For example, in one embodiment, a set of components can be implemented in a single IC chip. In other embodiments, one or more of respective components are fabricated or implemented on separate IC chips.

What has been described above includes examples of the embodiments of the present invention. It is, of course, not possible to describe every conceivable combination of components or methodologies for purposes of describing the claimed subject matter, but it is to be appreciated that many further combinations and permutations of the various embodiments are possible. Accordingly, the claimed subject matter is intended to embrace all such alterations, modifications, and variations that fall within the spirit and scope of the appended claims. Moreover, the above description of illustrated embodiments of the subject disclosure, including what is described in the Abstract, is not intended to be exhaustive or to limit the disclosed embodiments to the precise forms disclosed. While specific embodiments and examples are described in this disclosure for illustrative purposes, various modifications are possible that are considered within the scope of such embodiments and examples, as those skilled in the relevant art can recognize.

In particular and in regard to the various functions performed by the above described components, devices, circuits, systems and the like, the terms used to describe such components are intended to correspond, unless otherwise indicated, to any component which performs the specified function of the described component (e.g., a functional equivalent), even though not structurally equivalent to the disclosed structure, which performs the function in the disclosure illustrated exemplary aspects of the claimed subject matter. In this regard, it will also be recognized that the various embodiments include a system as well as a computer-readable storage medium having computer-executable instructions for performing the acts and/or events of the various methods of the claimed subject matter.

The aforementioned systems/circuits/modules have been described with respect to interaction between several components/blocks. It can be appreciated that such systems/circuits and components/blocks can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described in this disclosure may also interact with one or more other components not specifically described in this disclosure but known by those of skill in the art.

In addition, while a particular feature of the various embodiments may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

As used in this application, the terms "component," "module," "system," or the like are generally intended to refer to a computer-related entity, either hardware (e.g., a circuit), a combination of hardware and software, software, or an entity related to an operational machine with one or more specific functionalities. For example, a component may be, but is not limited to being, a process running on a processor (e.g., digital signal processor), a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers. Further, a "device" can come in the form of specially designed hardware; generalized hardware made specialized by the execution of software thereon that enables the hardware to perform specific function; software stored on a computer readable storage medium; software transmitted on a computer readable transmission medium; or a combination thereof.

Moreover, the words "example" or "exemplary" are used in this disclosure to mean serving as an example, instance, or illustration. Any aspect or design described in this disclosure as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Computing devices typically include a variety of media, which can include computer-readable storage media and/or communications media, in which these two terms are used in this description differently from one another as follows. Computer-readable storage media can be any available storage media that can be accessed by the computer, is typically of a non-transitory nature, and can include both volatile and nonvolatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, EEPROM, flash memory or other memory technology, CD-ROM, digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal that can be transitory such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, RF, infrared and other wireless media.

In view of the exemplary systems described above, methodologies that may be implemented in accordance with the described subject matter will be better appreciated with reference to the flowcharts of the various figures. For simplicity of explanation, the methodologies are depicted and described as a series of acts. However, acts in accordance with this disclosure can occur in various orders and/or concurrently, and with other acts not presented and described in this disclosure. Furthermore, not all illustrated acts may be required to implement the methodologies in accordance with certain aspects of this disclosure. In addition, those skilled in the art will understand and appreciate that the methodologies could alternatively be represented as a series of interrelated states via a state diagram or events. Additionally, it should be appreciated that the methodologies disclosed in this disclosure are capable of being stored on an article of manufacture to facilitate transporting and transferring such methodologies to computing devices. The term article of manufacture, as used in this disclosure, is intended to encompass a computer program accessible from any computer-readable device or storage media.

What is claimed is:

1. A method, comprising:

capturing, by a device comprising a processor and useable with a head apparatus, sound data representative of a warning sound originating externally to the head apparatus, wherein the capturing comprises capturing the sound data by a left acoustic microphone associated with a left ear section of the head apparatus and capturing the sound data by a right acoustic microphone associated with a right ear section of the head apparatus;

initiating, by the device, rendering of sound waves out of phase between a left speaker of the head apparatus and a right speaker of the head apparatus, resulting in formation of an acoustic echo cancelling region with respect to a first position of the left acoustic microphone, a second position of the right acoustic microphone and a third position of a source of speech sound that is not external to the head apparatus;

after the formation of the acoustic echo cancelling region and in connection with rendering further sound received by the left acoustic microphone and the right acoustic microphone, filtering, by the device, environmental noise from the further sound, wherein the environmental noise is determined to originate outside the echo cancelling region; and modifying, by the device, a first signal intensity of the warning sound originating externally to the head apparatus according to a proximity of a source of the warning sound in relation to the head apparatus, resulting in a second signal intensity, wherein the modifying the first signal intensity of the warning sound comprises rendering the warning sound via at least one of the left speaker of the head apparatus or the right speaker of the head apparatus according to the proximity of the source of the warning sound.

2. The method of claim 1, further comprising:

estimating, by the device, a distance of an apparatus generating the warning sound from the device.

3. The method of claim 2, further comprising:

initiating, by the device, rendering of an announcement sound comprising a spoken description of the distance of the apparatus generating the warning sound from the device.

4. The method of claim 1, further comprising:

estimating, by the device, a relative location of an apparatus generating the warning sound in relation to the device.

5. The method of claim 4, further comprising:

initiating, by the device, rendering of an announcement sound comprising a spoken description of the relative location of the apparatus generating the warning sound in relation to the device.

6. The method of claim 2, further comprising:

determining, by the device, an imminence of a potential danger based at least in part on the distance of the apparatus generating the warning sound from the device.

7. The method of claim 6, further comprising:

initiating, by the device, rendering of an announcement sound comprising a spoken description of the imminence of the potential danger.

8. The method of claim 1, further comprising:

classifying, by the device, at least one of the warning sound, an apparatus generating the warning sound, or an emergency scenario associated with the warning sound, resulting in at least one classification.

9. The method of claim 8, further comprising:

initiating, by the device, rendering of an announcement sound comprising a spoken description of the at least one classification.

10. A non-transitory computer-readable medium having stored thereon instructions that, in response to execution, cause a system comprising a processor and useable with a head apparatus to perform operations, the operations comprising:

capturing sound data representative of a warning sound originating externally to the head apparatus, wherein the capturing comprises capturing the sound data by a left acoustic microphone of the head apparatus and capturing the sound data by a right acoustic microphone of the head apparatus;

initiating rendering of sound waves out of phase between a left speaker of the head apparatus and a right speaker of the head apparatus, resulting in formation of an acoustic echo cancelling region within the head apparatus;

after the formation of the acoustic echo cancelling region and in connection with rendering further sound data received by the left acoustic microphone and the right acoustic microphone, filtering environmental noise from the further sound data, wherein the environmental noise is determined to originate outside the echo cancelling region, and wherein the further sound data comprises a warning sound; and increasing a first signal intensity of the warning sound originating externally to the head apparatus according to a proximity of a source of the warning sound in relation to the head apparatus, resulting in a second signal intensity, wherein the increasing the first signal intensity of the warning sound comprises rendering the warning sound via at least one of the left speaker of the head apparatus or the right speaker of the head apparatus according to the proximity of the source of the warning sound.

11. The non-transitory computer-readable medium of claim 10, wherein the operations further comprise:

estimating a distance of an apparatus generating the warning sound from the system.

12. The non-transitory computer-readable medium of claim 11, wherein the operations further comprise at least one of the following:

initiating rendering of an audible indication of the distance of the apparatus generating the warning sound from the system; or determining a probability of a dangerous condition manifesting based at least in part on the distance of the apparatus generating the warning sound from the system, and, based on the probability being determined to exceed a threshold probability, initiating rendering of an audible indication of the dangerous condition as having a potential to manifest.

13. The non-transitory computer-readable medium of claim 10, wherein the operations further comprise:

estimating a relative location of an apparatus generating the warning sound in relation to the system.

14. The non-transitory computer-readable medium of claim 13, wherein the operations further comprise:

initiating rendering of an audible indication of the relative location of the apparatus generating the warning sound in relation to the system.

15. The non-transitory computer-readable medium of claim 10, wherein the operations further comprise:

classifying at least one of the warning sound, an apparatus generating the warning sound, or an emergency scenario associated with the warning sound, resulting in at least one classification.

16. The non-transitory computer-readable medium of claim 15, wherein the operations further comprise:

initiating rendering of an audible indication of the at least one classification.

17. A method, comprising:

capturing, by a device comprising a processor and useable with a head apparatus, sound data representative of a warning sound originating externally to the head apparatus, wherein the capturing comprises capturing the sound data by a left acoustic microphone associated with a left ear section of the head apparatus and capturing the sound data by a right acoustic microphone associated with a right ear section of the head apparatus;

initiating, by the device, rendering of sound waves out of phase between a left speaker of the head apparatus and a right speaker of the head apparatus, resulting in formation of an acoustic echo cancelling region with respect to a first position of the left acoustic microphone, a second position of the right acoustic microphone and a third position of a source of speech sound that is not external to the head apparatus;

after the formation of the acoustic echo cancelling region and in connection with rendering further sound received by the left acoustic microphone and the right acoustic microphone, filtering, by the device, environmental noise from the further sound, wherein the environmental noise is determined to originate outside the echo cancelling region; and modifying, by the device, a first signal intensity of the warning sound originating externally to the head apparatus according to a proximity of a source of the warning sound in relation to the head apparatus, resulting in a second signal intensity, wherein the modifying the first signal intensity of the warning sound comprises rendering the warning sound via at least one of the left speaker of the head apparatus or the right speaker of the head apparatus according to the proximity of the source of the warning sound.

18. The method of claim 17, further comprising:

preventing capture by the left acoustic microphone and the right acoustic microphone of external sound, wherein the external sound is determined to originate outside a spatial region between the left acoustic microphone and the right acoustic microphone.

19. The method of claim 17, further comprising:

increasing a signal to noise ratio of internal sound, wherein the third sound is determined to originate from within a spatial region between the left acoustic microphone and the right acoustic microphone.

20. The method of claim 17, further comprising:

adjusting a position of at least one of the left acoustic microphone, the right acoustic microphone, the left speaker, or the right speaker, thereby altering a size of a spatial region between the left acoustic microphone and the right acoustic microphone.

* * * * *